US008178181B2

(12) United States Patent
Rodriguez

(10) Patent No.: US 8,178,181 B2
(45) **Date of Patent: *May 15, 2012**

(54) TRANSFER TAPE FOR CUTTING AND SPOOLING A PAPER WEB

(76) Inventor: Peter A. Rodriguez, Atlantic Beach, FL (US)

( * ) Notice: Subject to any disclaimer, the term of this patent is extended or adjusted under 35 U.S.C. 154(b) by 296 days.

This patent is subject to a terminal disclaimer.

(21) Appl. No.: 12/655,053

(22) Filed: Dec. 22, 2009

(65) Prior Publication Data

US 2010/0104792 A1 Apr. 29, 2010

Related U.S. Application Data

(63) Continuation-in-part of application No. 12/009,025, filed on Jan. 16, 2008, now Pat. No. 8,124,209, which is a continuation-in-part of application No. 10/794,022, filed on Mar. 5, 2004, now abandoned.

(51) Int. Cl.
*B32B 9/00* (2006.01)
*B32B 23/02* (2006.01)

(52) U.S. Cl. ..... 428/40.1; 428/41.7; 428/41.8; 428/41.9; 428/42.1; 428/42.2; 428/42.3; 428/192; 428/194

(58) Field of Classification Search ..... 428/40.1, 428/41.7, 41.8, 41.9, 42.1, 42.2, 42.3, 192, 428/194

See application file for complete search history.

(56) References Cited

U.S. PATENT DOCUMENTS

| | | | | |
|---|---|---|---|---|
| 2,461,246 | A | 2/1949 | Weyenburg | |
| 4,659,029 | A | 4/1987 | Rodriguez | |
| 4,757,950 | A | 7/1988 | Rodriguez | |
| 4,783,018 | A | 11/1988 | Rodriguez | |
| 5,046,675 | A | 9/1991 | Rodriguez | |
| 5,212,002 | A | 5/1993 | Madrzak et al. | |
| 5,323,981 | A | 6/1994 | Dionne | |
| 5,453,141 | A | 9/1995 | Rodriguez | |
| 5,637,170 | A | 6/1997 | Rodriguez | |
| 5,810,279 | A | 9/1998 | Rodriguez et al. | |
| 5,954,290 | A | 9/1999 | Rodriguez et al. | |
| 6,467,719 | B1 | 10/2002 | Rodriguez | |
| 7,766,273 | B2 * | 8/2010 | Rodriguez | 242/532.3 |
| 2008/0113142 | A1 * | 5/2008 | Rodriguez | 428/41.8 |

* cited by examiner

*Primary Examiner* — Patricia Nordmeyer
(74) *Attorney, Agent, or Firm* — Thomas C. Saitta

(57) ABSTRACT

A paper web transfer tape having a cover flap joined longitudinally to a carrier member along the trailing edge such that the cover flap opens in a hinged manner to expose a pressure sensitive adhesive layer on the carrier member for adherence to an advancing paper web for severance and transfer of the paper web onto an empty spool. The transfer tape is adhered to an empty spool. The cover flap is opened by air resistance encountered during rotation of the empty spool.

16 Claims, 12 Drawing Sheets

TRANSFER TAPE FOR CUTTING AND SPOOLING A PAPER WEB

This application is a continuation-in-part of and claims the benefit of U.S. patent application Ser. No. 12/009,025, filed Jan. 16, 2008, now U.S. Pat. No. 8,124,029, which is a continuation-in-part application of U.S. patent application Ser. No. 10/794,022, filed Mar. 5, 2004, now abandoned.

BACKGROUND OF THE INVENTION

This invention relates generally to the field of devices, apparatuses and methods of effecting high speed severing and transfer of a rapidly advancing paper web from one spool onto an empty spool, and more particularly where such an operation is performed utilizing a transfer or turn-up tape. More particularly, the invention relates to an improved transfer tape and its use in a paper web severing/transfer method, wherein the transfer tape is the effecting means for severing, transferring and securing the paper web from a full spool onto an empty spool.

Modern paper manufacture is typically performed by producing continuous sheets of paper having widths of up to 330 inches in some cases, referred to as paper webs, which are wound onto spools for subsequent processing, storage, transfer or the like. The spooling operation for the paper web occurs at high speeds, in some cases as high as 8000 feet per minute, and in order to maximize production by minimizing downtime it is desirable to sever and then transfer the moving web from a full spool onto an empty spool without stopping or slowing movement of the web. Methods and apparatuses for accomplishing this severing and transfer utilizing what is known as a transfer or turn-up tape have long been known. An early example of such a system is shown in U.S. Pat. No. 2,461,246 to Weyenberg, issued in 1949. Other examples are shown in my U.S. Pat. Nos. 4,659,029, 4,757,950, 4,783,018, 5,046,675, 5,453,141, 5,637,170, and 5,954,290. Examples of different types of transfer systems are shown in my U.S. Pat. Nos. 4,467,719 and 5,810,279.

The transfer tape utilized in severing and transferring the paper web has at least one adhesive side, preferably comprised of a pressure sensitive adhesive (PSA), that contacts and adheres to the web, such that in certain systems the web is transversely severed as the tape is brought onto the empty spool. In other systems, the transfer tape is already adhered to the empty spool, in which case the web adheres to the tape as the spool rotates, with the web severing as the travel direction of the tape pulls away from the direction of travel of the paper web.

The high-speed transfer of lightweight paper webs, such as newsprint or tissue paper, is more difficult to accomplish due to the weaker structure of the paper. In addition, where adhesive transfer tapes are used, the exposed adhesive side of the transfer tape is often contaminated with airborne dust, floating paper fibers and other debris, such that the adhesion is weakened or even blinded completely, which can result in a failed transfer.

It is an object of this invention to provide an improved transfer tape and an improved method of severing and transferring a continuous paper web from a full spool to an empty spool, such as are especially useful in transferring lightweight papers such as tissue or newsprint, wherein the transfer tape is improved by providing a permanently attached, longitudinally extensive cover flap member that protects a pressure sensitive adhesive layer on the tape by preventing contamination from airborne dust, paper fibers or other debris. It is a further object to provide such a transfer tape and method of utilizing the tape wherein the cover flap is self-opening as a result of the air resistance encountered during rotation of the empty spool. These and other objects not expressly set forth in this paragraph will be addressed in the disclosure to follow.

SUMMARY OF THE INVENTION

The invention is a new structure for a paper web transfer tape used in web spooling, transfer or turn-up operations wherein a continuously and rapidly advancing paper web that is being wound onto a first spool is cut and then transferred onto a second spool without stopping or slowing the advancing paper web. The transfer tape comprises an elongated, thin carrier member having a pressure sensitive adhesive (PSA) coating applied to both sides. The PSA coating on the first side is temporarily covered by a cover flap comprising a flap member composed of paper or the like that is provided with a partial release layer coating of silicone or the like, such that the cover flap does not adhere to the PSA coating. The cover flap is permanently adhered to the carrier member along or adjacent a longitudinal edge of the carrier member such that the cover flap easily opens in a hinged manner to expose the PSA coating to affix to the paper web, yet remains attached to the transfer tape so that it does not foul the equipment. The cover flap prevents adhesion of environmental dust, paper fibers and other airborne debris that will diminish the adhesive strength of the PSA coating, possibly to the point where the tape will not adhere to the paper web. In certain embodiments the transfer tape provides an extended cover flap of greater width than the PSA coating. Other alternative embodiments provide longitudinal fold lines, such as score lines, creases or cuts made through or into one or more layers, on one or both sides of the transfer tape, thereby creating a more defined hinge member that opens more easily.

The transfer tape is adhered to an empty spool such that free or leading edge of the cover flap faces in the direction of rotation of the spool, such that air pressure encountered by rotation of the tape causes the cover flap to fold or pivot backward, thus exposing the PSA coating just prior to its coming into contact with the advancing paper web. As the tape adheres to the paper web, the paper web is torn transversely or convolutedly and is transferred to the new spool.

DETAILED DESCRIPTION OF THE INVENTION

With reference to the drawings, the invention will now be described with regard for the best mode and the preferred embodiment. The drawings are not to scale, in that the thicknesses of various layers are exaggerated for clarity. In practice, the PSA layers and the release layers, which are applied coatings, will be significantly thinner than the paper carrier member and the flap member. In general, the invention is a device or apparatus for cutting, transferring and spooling a rapidly traveling web of paper, the apparatus comprising a transfer tape of novel structure, and the method or process utilizing such transfer tape whereby a rapidly traveling paper web being wound onto a first spool is cut and directed onto a second spool.

The transfer tape 10, various embodiments of which are illustrated in FIGS. 1 through 6 and 10 through 17 (wherein the representative layers are not drawn to scale but are provided with enlarged thicknesses for illustrative purposes), is a longitudinally extended, multi-layer member having a ribbon-like configuration, such that it is relatively thin with a relatively small width, with representative dimensions being for example approximately one inch in width and less than approximately one mm in total thickness. It is understood that particular dimensions will vary dependent on the particular spooling system or application parameters.

Figure 1:
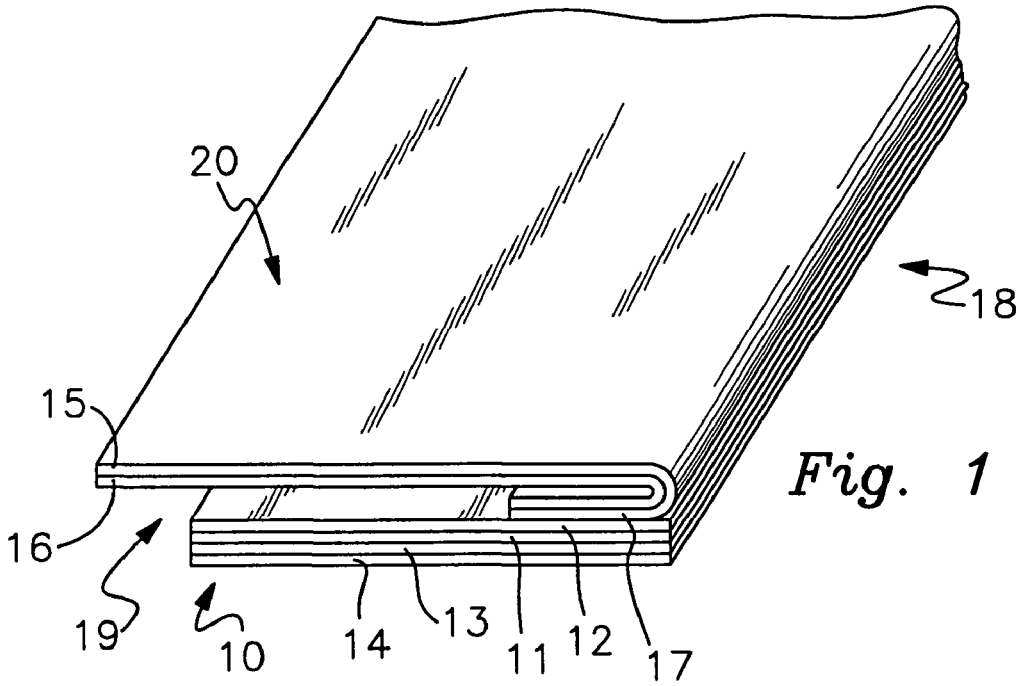
FIG. 1 is a perspective view of a portion of an embodiment of the transfer tape of the invention.

As shown in FIG. 1, a basic embodiment of the transfer tape 10 comprises a carrier member 11 having a first pressure sensitive adhesive (PSA) layer 12 applied to or coated on a first side of said carrier member 11 and a second pressure sensitive adhesive layer 13 applied to or coated on a second side of said carrier member 11. The PSA layers 12 and 13 preferably cover the full extent of both sides of the carrier member 11, but may also be applied intermittently in localized regions, in longitudinal stripes, etc. The carrier member 11 provides strength and structural integrity to the transfer tape 10 and is composed of any suitable material known in the industry capable of receiving and retaining an adhesive. Carrier members 11 composed of paper are well known in the industry. Preferably, the carrier member 11 and other components of the transfer tape 10 are composed of a paper or similar material that is recyclable or re-pulpable. The PSA layers 12 and 13 are composed of any such adhesive suitable for application to and retention by the carrier member 11 that is also suitable for adhesion to the paper web being spooled. A removable release liner member 14 is temporarily applied to cover the second PSA layer 13 on the carrier member 11. The release liner member 14 is composed of a material or incorporates a release material, such as for example a silicone coating or impregnation, such that the release liner member 14 adheres in only a limited manner to the carrier member 11 in order to prevent undesired adhesion of the second PSA layer 13 to other objects prior to use, but which is easily removed therefrom when required. As will be clear in the later disclosure, use of a removable release layer 14 is not the most advantageous embodiment, since use of the transfer tape 10 requires the operation of removing the release layer 14, thereby producing waste and requiring labor time and cost.

A cover flap 20 comprising a flap member 15 composed of a kraft paper or similar material that will adhere to the first PSA layer 12 is provided, with the interior side of the flap member 15 being provided with a release coating or layer 16, composed for example of a silicone coating or the like, characterized in that the interior side of the flap member 15 does not adhere to the first PSA layer 12 on the carrier member 11. The flap member 15 is of greater overall width than the carrier member 11, such as for example approximately 1.5 inches for a carrier member 11 having a width of approximately one inch. The flap member 15 is folded longitudinally to create a short attachment flange member 17, such as for example approximately 0.25 inches in width for a flap member 15 width of approximately 1.5 inches, and is folded such that the flap release layer 16 is folded upon itself. The flap member 15 is then permanently attached to the carrier member 11 by adhering the flap member 15 along one longitudinal edge of the first PSA layer 12 on the carrier member 11, with the remainder of the flap member 15 extending laterally across the first PSA layer 12 of the carrier member 11 and slightly beyond—approximately 0.25 inches for the representative dimensions given above. The flap release layer 16 prevents the interior side of the flap member 15 from adhering to the first PSA layer 12, and for this purpose must be correspondingly disposed opposite to all of the exposed first PSA layer 12. The longitudinal edge of the transfer tape 10 to which the flap member 15 is joined defines the trailing edge 18, with the opposite longitudinal edge of the transfer tape 10 being the leading edge 19. The cover flap 20 is thus able to open in a hinged manner to expose the first PSA layer 12, with the cover flap 20 remaining attached to the carrier member when opened.

With this construction, the first PSA layer 12 of the transfer tape 10 is covered by the cover flap 20 such that the first PSA layer 12 is protected from environmental dust, floating paper fibers and other atmospheric debris prior to use. In this manner, environmental dust, fibers and debris will not detrimentally reduce the adhesion properties of the first PSA layer 12. As explained in detail below, the cover flap 20 is opened to expose the first PSA layer 12 only immediately prior to the cutting and transfer operation, thus insuring that sufficient adhesive surface area remains for the transfer tape 10 to adhere to the paper web being transferred.

Figure 3:
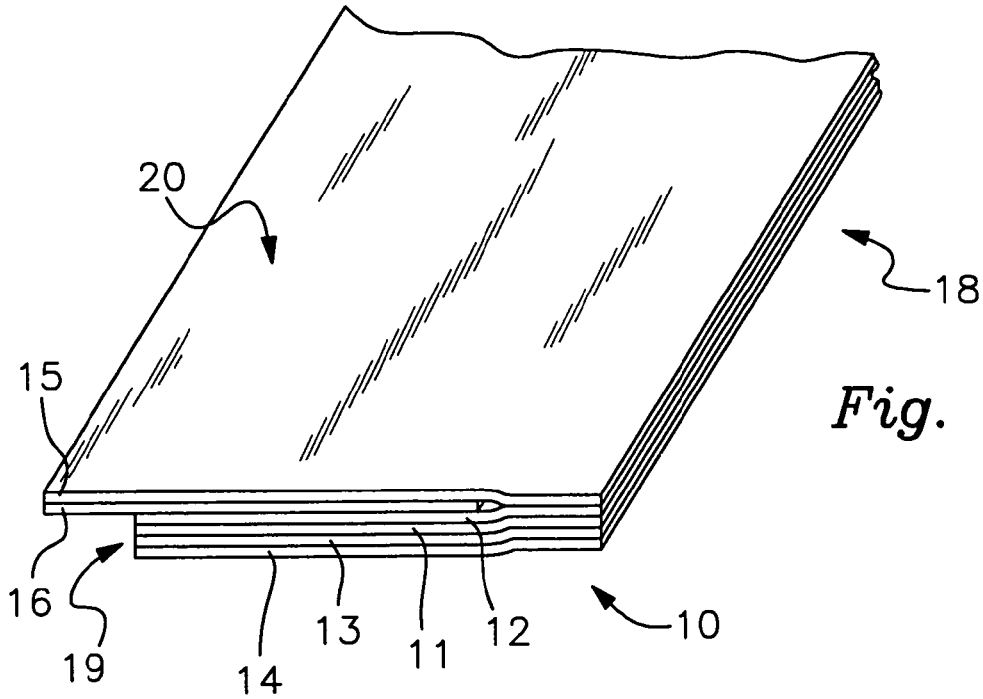
FIG. 3 is a perspective view of a portion of an alternative embodiment of the transfer tape, wherein the cover flap is not folded.

An alternative embodiment for the transfer tape 10 is shown in FIG. 3, wherein the transfer tape 10 is composed of a carrier member 11, a first PSA layer 12, a second PSA layer 13 and a release liner member 14 as described above. The cover flap 20 is again comprised of a flap member 15 composed of a kraft paper or similar material that will adhere to the first PSA layer 12. The flap member 15 is preferably slightly wider than the carrier member 11 such that it will extend beyond the leading edge 19. For example, for a carrier member 11 having a width of approximately one inch, the flap member 15 may be 1.25 inches in width. The interior side of the flap member 15 is partially coated with a flap release layer 16 comprising a material that prevents the flap member 15 from adhering to the first PSA layer 12, such as for example a silicone coating. The flap member 15 is coated such that all, or suitable intermittent portions, of the strip or edge of the interior side of flap member 15 along the trailing edge 18 is uncoated, such that this uncoated strip portion will permanently adhere directly to the first PSA layer 12 of the carrier member 11. For example, the flap release layer 16 may be applied in an approximately one inch width, leaving an uncoated strip of approximately of 0.25 inches on the 1.25 inch flap member 15 to adhere to the carrier member 11. In this construction, the flap member 15 is not in a folded configuration, which advantageously allows the transfer tape 10 to be rolled upon itself prior to use for ease of storage and transport.

Figure 2:
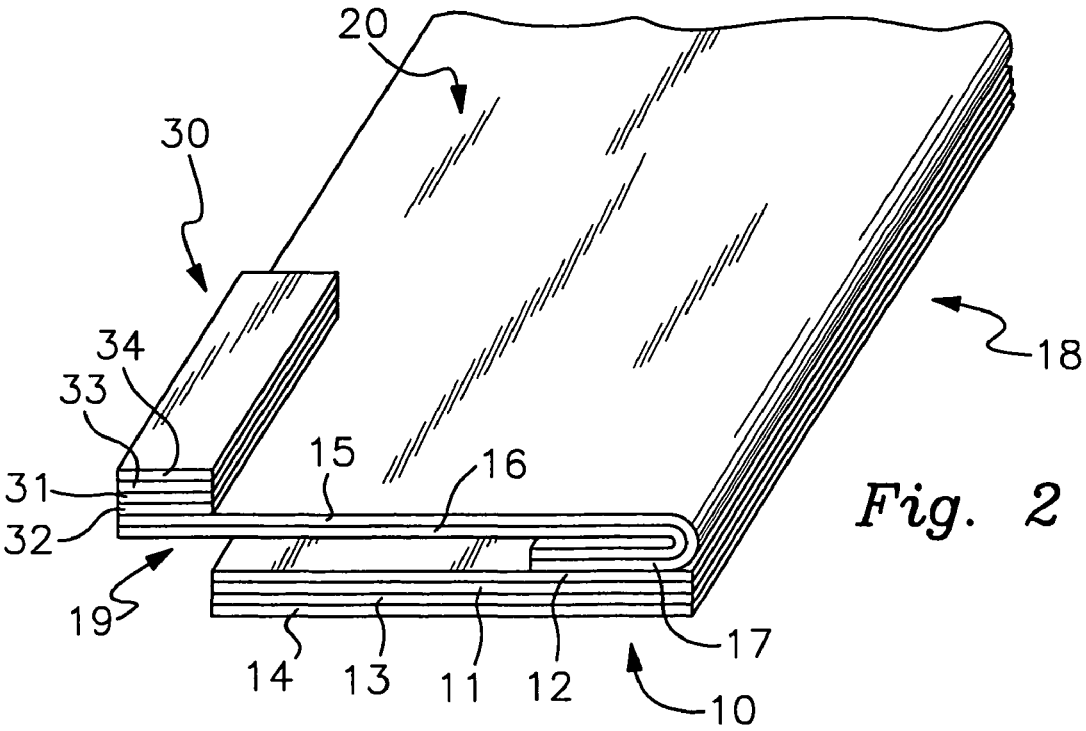
FIG. 2 is a perspective view of an alternative embodiment, wherein an adhesive tab member is provided on the cover flap of the transfer tape of FIG. 1.
Figure 4:
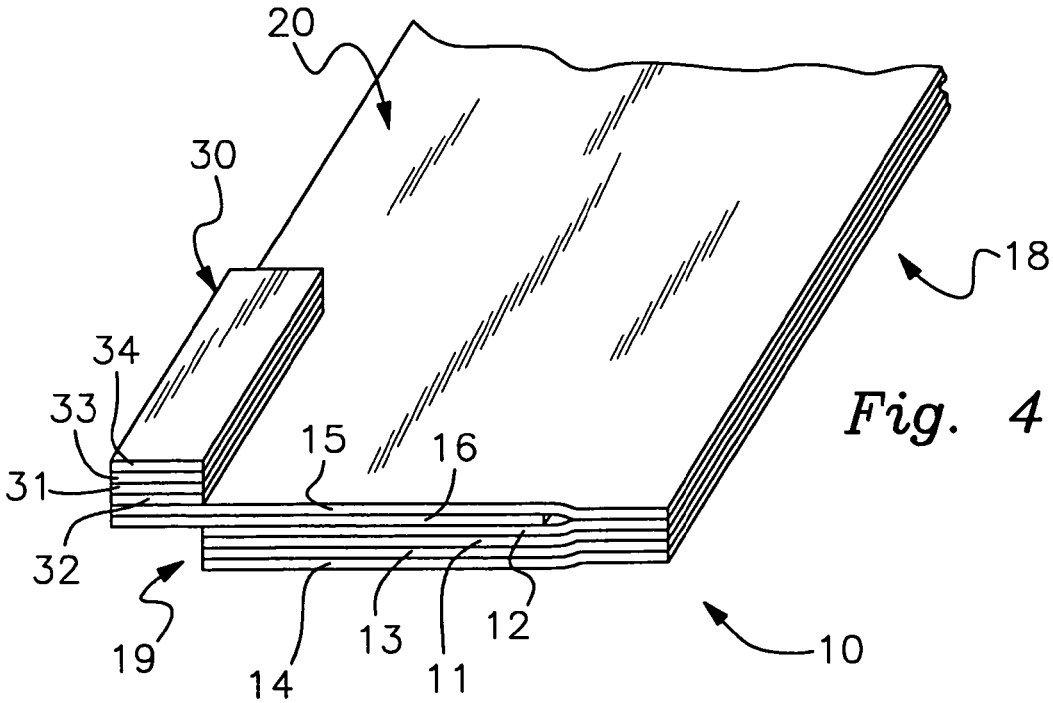
FIG. 4 is a perspective view of an alternative embodiment, wherein an adhesive tab member is provided on the cover flap of the transfer tape of FIG. 3.

In FIGS. 2 and 4, alternative embodiments are illustrated wherein in each structure the cover flap 20 is provided with an adhesive tab member 30 of relatively short longitudinal and width dimensions in comparison to the transfer tape 10. FIG. 2 shows the tab member 30 as applied to the transfer tape 10 of FIG. 1, and FIG. 4 shows the tab member 30 as applied to the transfer tape of FIG. 3. The tab member 30 is disposed at or adjacent the corner of the leading edge 19 of the transfer tape 10 on the flap member 15. The tab member 30 comprises a tab carrier member 31 composed of a paper or similar material able to retain or absorb a PSA coating, such that a first PSA layer 32 and a second PSA layer 33 are applied to opposing sides of the tab carrier member 31. The second PSA layer 33 adheres the tab member 30 to the exterior side of the flap member 15. A removable release liner member 34 composed of a material or a coating that allows slight adhesion to the first PSA layer 32 is positioned on the external side of the tab carrier member 31. The tab release liner member 34 is removed prior to use of the transfer tape 10. The adhesive tab member 30 is used to assist in opening the cover flap 20 when heavier grade papers are being spooled by bringing the tab member 30 into contact with the reel drum beyond the edge of he advancing paper web 50.

Figure 5:
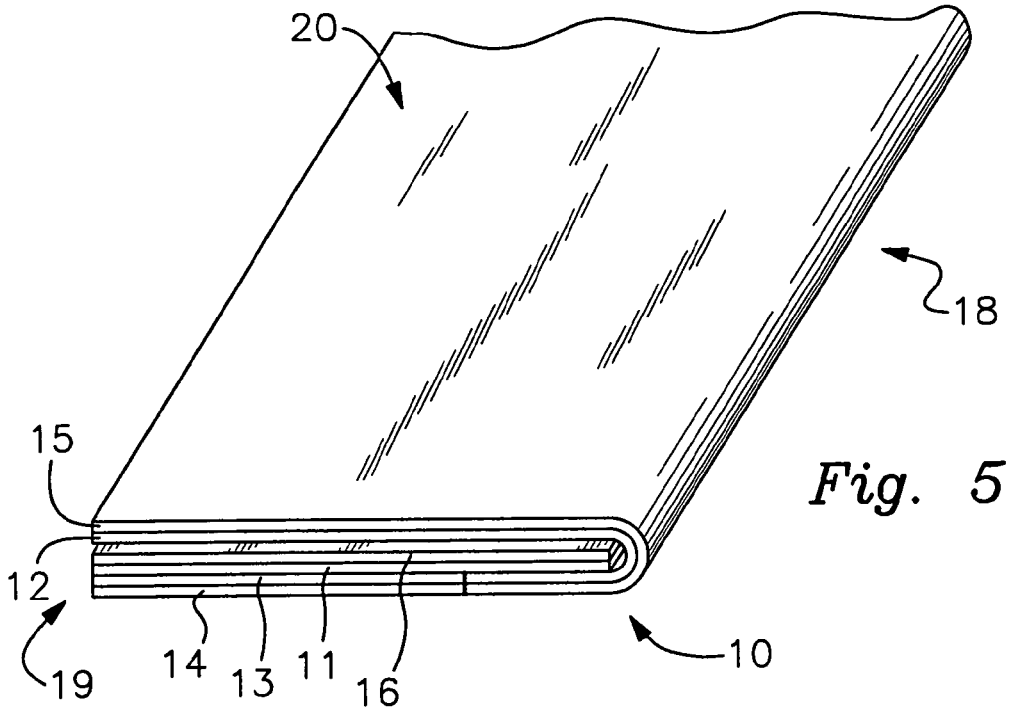
FIG. 5 is a perspective view of an alternative embodiment, wherein the cover flap is attached to the underside of the carrier member.

FIG. 5 illustrates another alternative embodiment for the transfer tape 10. In this embodiment, the cover flap 20 adheres to the paper web 50 being transferred. The cover flap 20 comprises the flap member 15 and a first PSA layer 12, which is applied to the underside or interior side of flap member 15. A flap release layer 16 is disposed on the upper side or interior of carrier member 11, such that it is disposed between the carrier member 11 and the flap member 15. The cover flap 20 folds or wraps around the trailing edge 18, such that a portion of the first PSA layer 12 adheres the flap member 15 to the carrier member 11. The carrier member 11 is provided on the underside or exterior with a second PSA layer 13 that is covered by a removable release liner member 14. The presence of flap release layer 16 allows the cover flap 20 to be easily opened to expose the first PSA layer 12 to the paper web 50.

Figure 6:
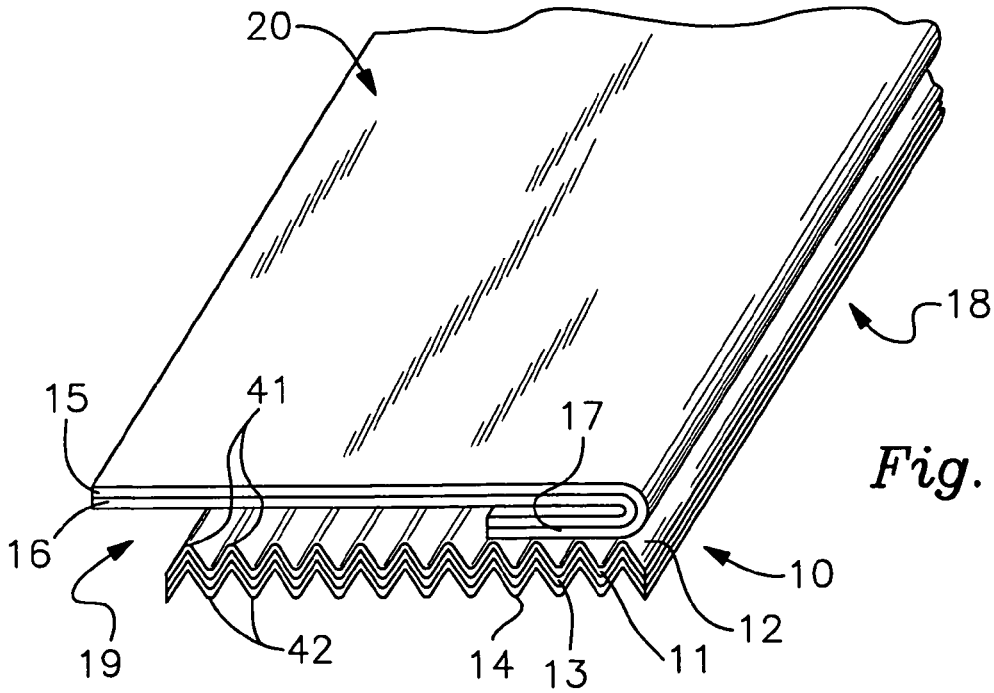
FIG. 6 is a perspective view of an alternative embodiment, wherein the carrier member of the transfer tape is longitudinally embossed.

FIG. 6 illustrates another alternative embodiment of the transfer tape 10. In this embodiment, the layers of the transfer tape correspond to the layers as shown in FIG. 1, but the assembly formed by the combination of the first PSA layer 12, the carrier member 11, the second PSA layer 13 and the release liner member 14 are longitudinally embossed to create a series of alternating ridges 41 and valleys 42. This configuration increases the structural rigidity of the transfer tape 10, while retaining sufficient adhesive contact area for the first and second PSA layers 12 and 13 to perform as required in the web transfer operation. The increased thickness of the transfer tape 10 and the compressibility of the transfer tape 10 increases the efficiency of the interference fit within the nip during the transfer operation.

Figure 10:
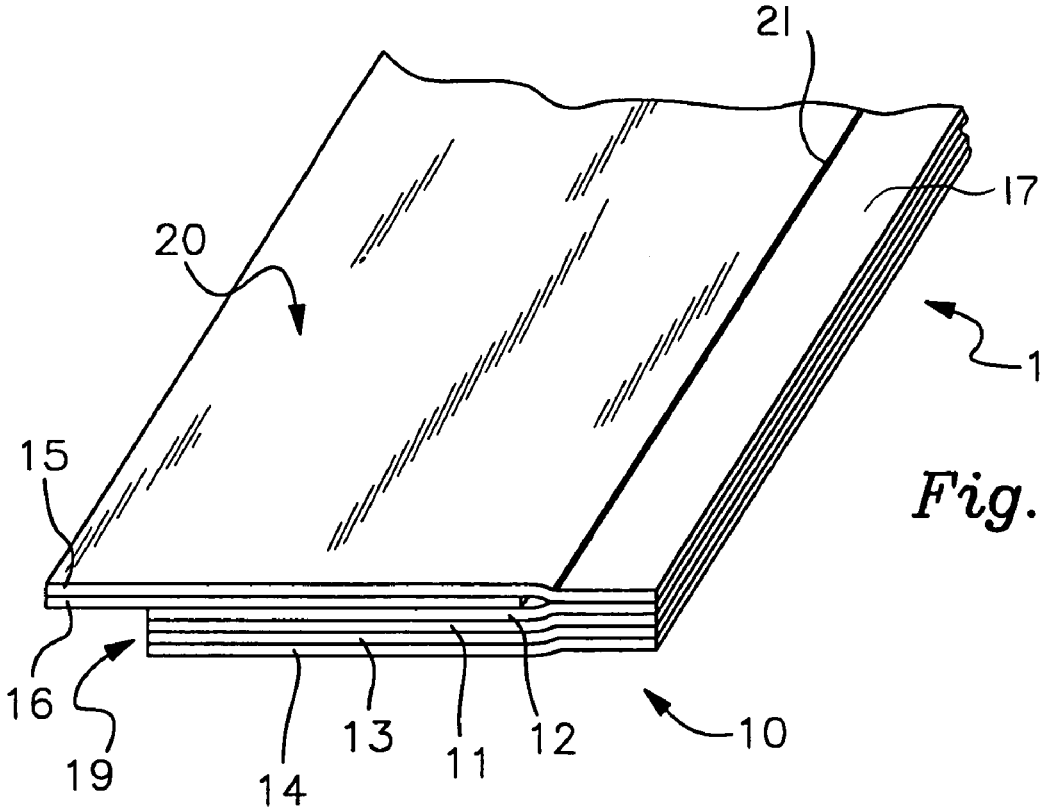
FIG. 10 is a perspective view of an alternative embodiment, similar to the embodiment of FIG. 3, wherein a longitudinal fold line is provided.

An improvement to the embodiment shown in FIG. 3 is illustrated in FIG. 10, wherein the flap member 15 is provided with a structural fold line 21 that extends longitudinally and parallel to the trailing edge 18, preferably at the location adjacent the trailing edge side 18 of the flap release layer 16 such that the non-adhered cover flap 20 opens in a hinged manner along this fold line 21. In other words, the fold line 21 is positioned along the junction between the attachment flange member 17, the portion of the flap member 15 permanently adhered to the carrier member 11, and the portion of the flap member 15 having the flap release layer 16, which opens during the cutting and transfer operation. The fold line 21, which may be produced by scoring, creasing, partial cutting or otherwise imparting a defined hinging line on the flap member, better defines the attachment flange member 17 and enables the flap member 15 to more easily and more fully open when used.

Figure 11:
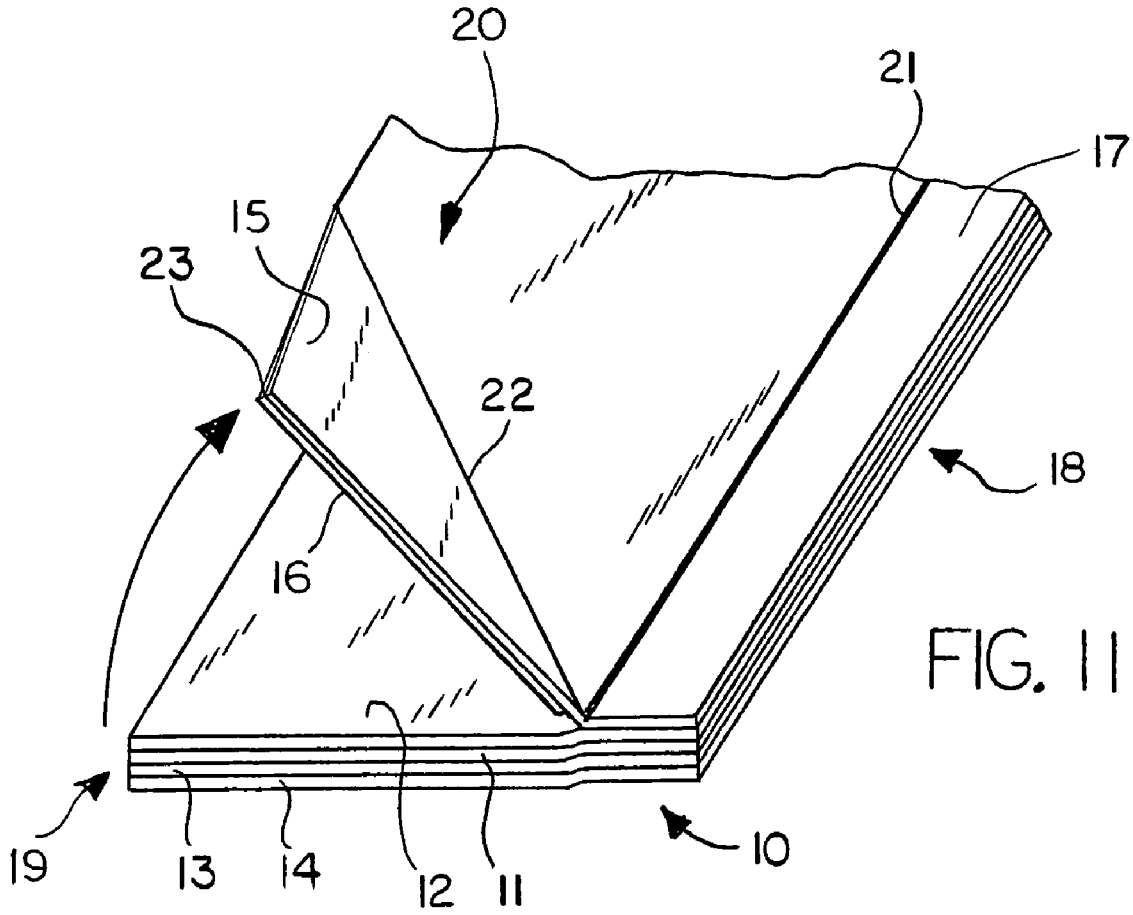
FIG. 11 is a perspective view of an alternative embodiment, similar to the embodiment of FIG. 10, wherein the corner of the leading edge is folded so as to expose a small portion of the first pressure sensitive adhesive layer.

In still another embodiment, as shown in FIG. 11, similar to the embodiments shown in FIGS. 3 and 10, the flap member 15 and its flap release layer 16 are folded or creased along corner fold line 22 in order to define a folded corner 23, such that the folded corner 23 extends away from the carrier member 11 to expose a small triangular portion of the PSA layer 12. With this structure, the cover flap 20 will "peel" open longitudinally when in use as described in more detail below.

Figure 12:
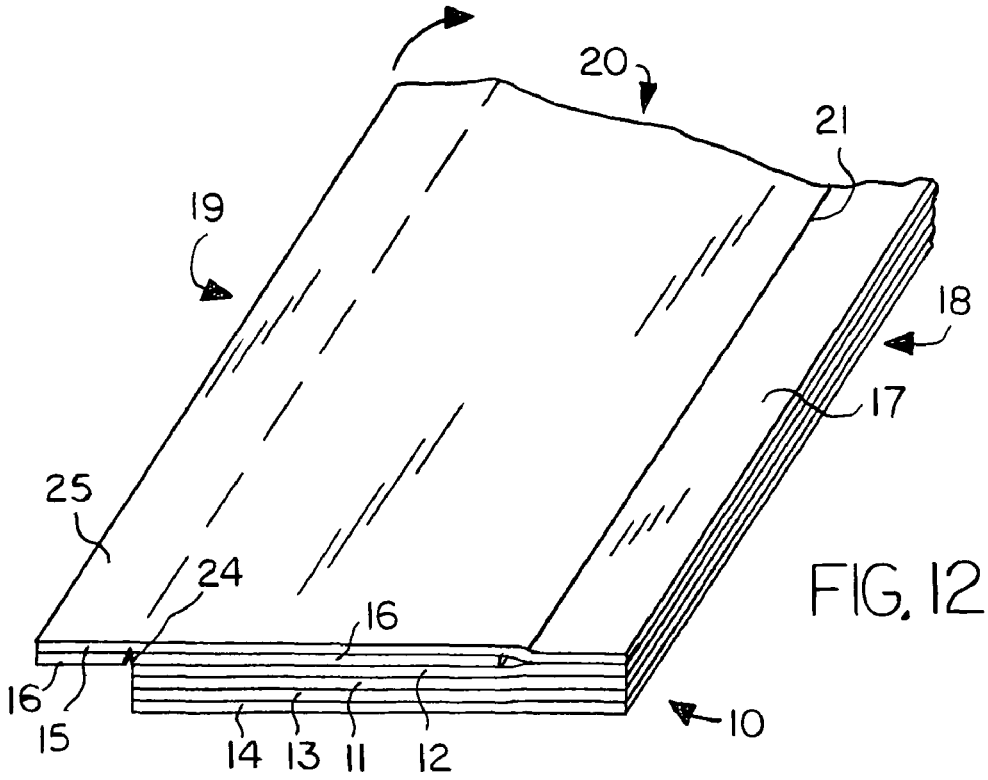
FIG. 12 is a perspective view of an alternative embodiment, similar to the embodiment of FIG. 10, wherein a secondary fold line is provided on the underside of the cover flap to more readily initiate opening of the cover flap.

FIG. 12 illustrates another improved embodiment to the transfer tape 10 illustrated in FIG. 10, wherein in addition to the upper side fold line 21 positioned between flap member 15 and attachment flange member 17, an underside fold line 24 is provided by cutting through or scoring the flap release layer 16 and cutting partially through or scoring the flap member 15 adjacent the leading edge 18. This creates a leading edge initiator flap member 25 which more readily opens upward by air pressure as the tape 10 is being rotated. It is not essential that the flap release layer 16 be disposed on the underside of the initiator flap member 25, since this portion does not contact the first PSA layer 12, but the flap release layer 16 may be present under the initiator flap member 25 as a result of the manufacturing process that is chosen. As before, the transfer tape 10 comprises a carrier member 11 having a first PSA layer 12 on its upper side and a second PSA layer 13 on its underside, the lower second PSA layer 13 being temporarily covered by a release liner member 14. The major portion of the cover flap 20 is comprised of a flap member 15 and the minor portion is comprised of an attachment flange member 17, wherein the underside of the flap member 15 is coated with a flap release layer 16, the attachment flange member 17 being uncoated so that it permanently adheres to the PSA layer 12 to define a hinge construction. In this embodiment, as the tape 10 is rotated the initiator flap member 25 opens first, followed immediately by the flap member 15 portion of the cover flap 20, thereby exposing the first PSA layer 12 to the paper web 50.

Figure 17:
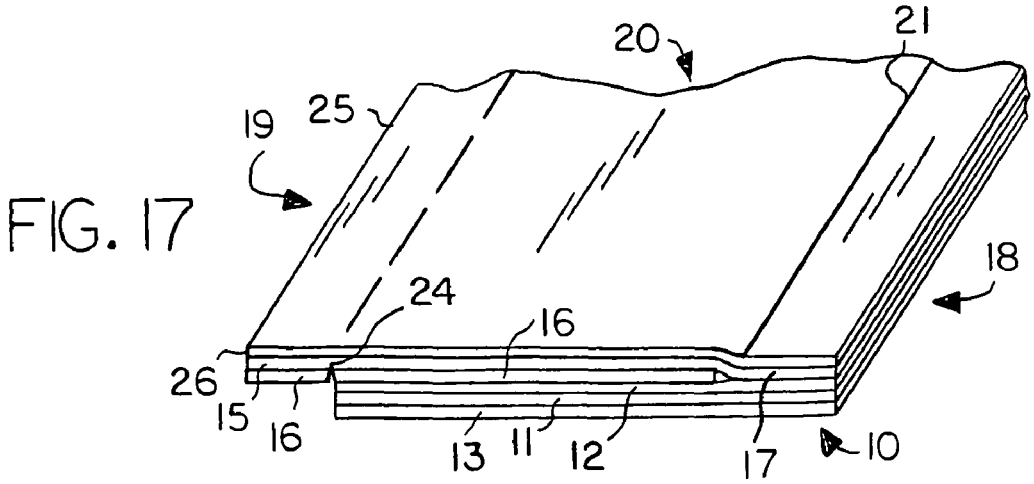
FIG. 17 is a perspective view of an alternative embodiment similar to FIG. 12, wherein the lower release liner member is replaced by an upper release layer.

FIG. 17 illustrates an alternative and preferred embodiment to that of FIG. 12, wherein the lower release liner member 14 is not present. Instead an upper roll release coating or layer 26, composed for example of a silicone coating or the like, is provided on the exposed upper surface of the flap member 15 and attachment flange 17. This allows the transfer tape 10 to be stored in a large roll prior to use without the need for a removable release liner member 14, since the upper roll release layer 26 prevents adhesion of the cover flap 20 to the second PSA layer 13 when the tape 10 is spirally wound onto itself. As before, it is not essential that the flap release layer 16 be disposed on the underside of the initiator flap member 25, since this portion does not contact the first PSA layer 12, but the flap release layer 16 may be present under the initiator flap member 25 as a result of the manufacturing process that is chosen.

Figure 13:
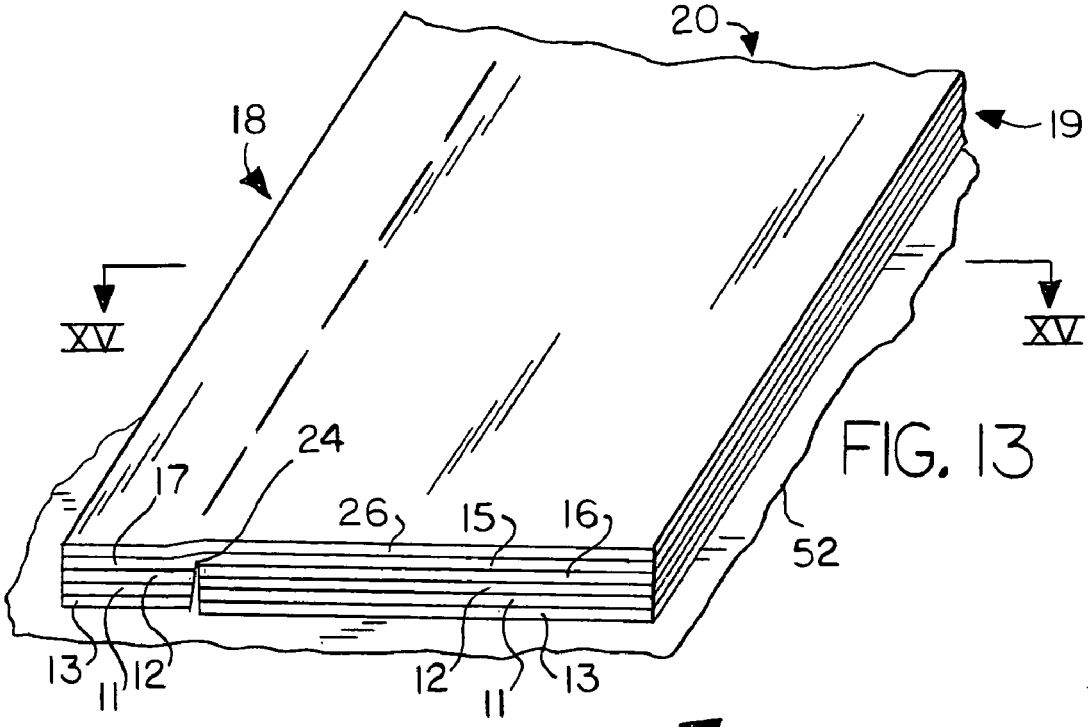
FIG. 13 is a perspective view of an alternative embodiment, wherein an underside fold line is created by cutting through the lower PSA layers.
Figure 14:
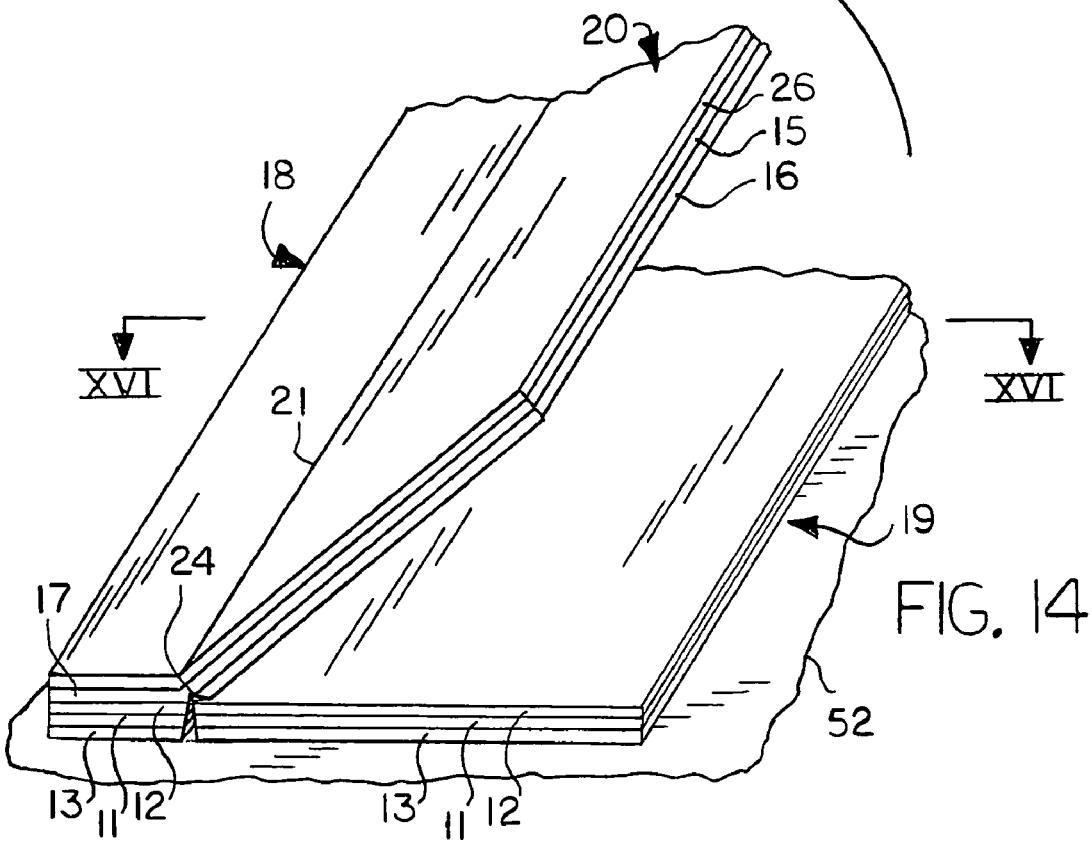
FIG. 14 is a perspective view of the embodiment of FIG. 13, shown with the cover flap in the open configuration.
Figure 15:
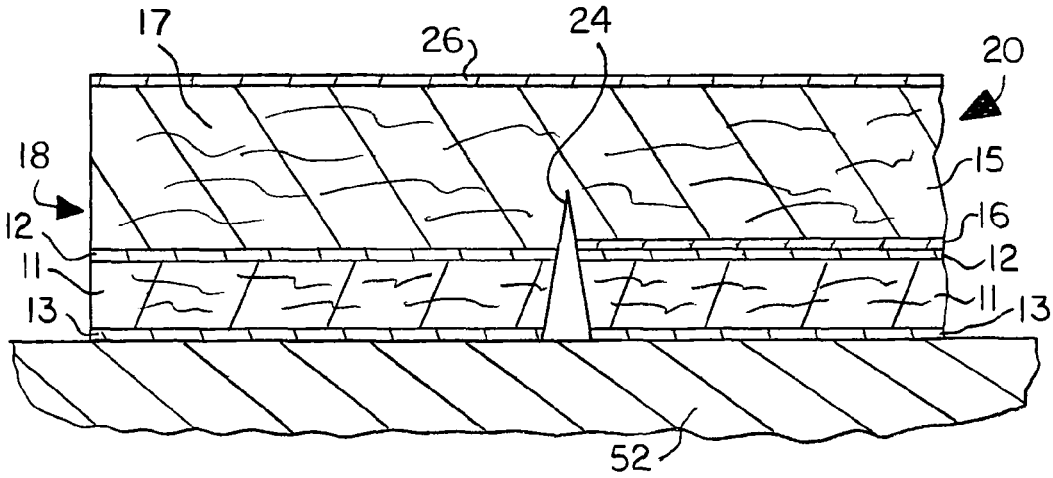
FIG. 15 is a partial cross-sectional view taken along line XV of FIG. 13.
Figure 16:
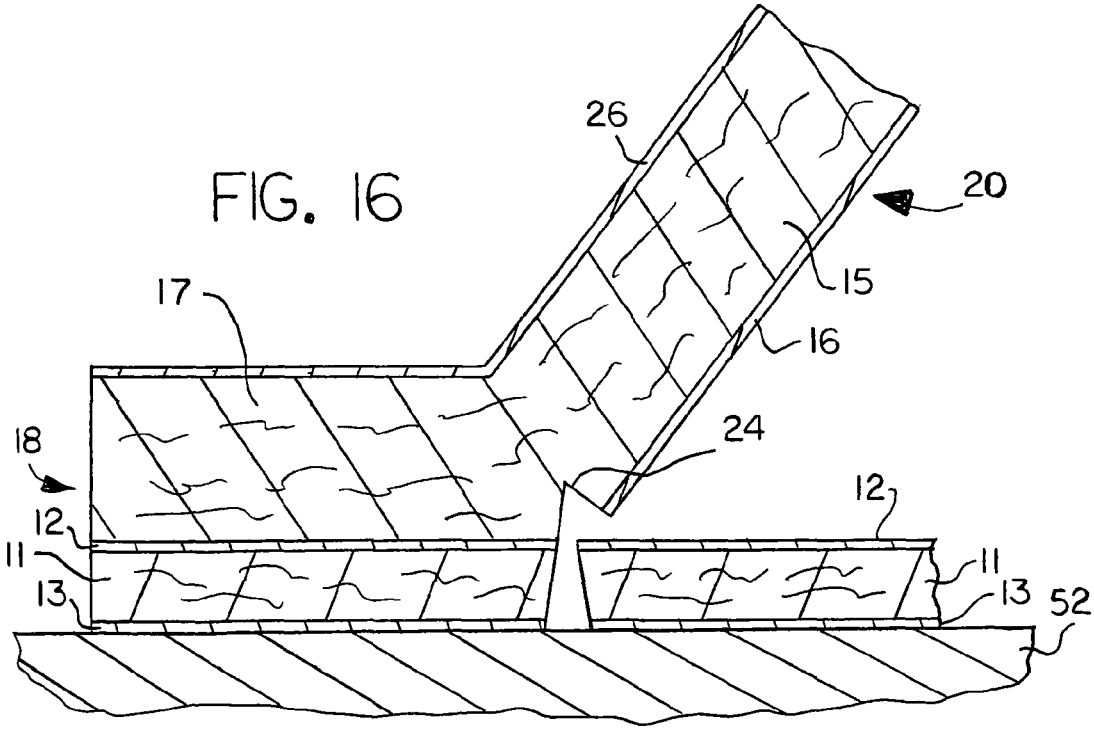
FIG. 16 is a partial cross-sectional view taken along line XVI of FIG. 14.

FIGS. 13 through 16 illustrate still another embodiment of the transfer tape 10, FIGS. 13 and 14 being perspective views and FIGS. 15 and 16 being partial cross-sectional views wherein the relative scale of the various layers is somewhat better presented for visualization purposes. As before, the transfer tape 10 comprises a carrier member 11 having a first PSA layer 12 on its upper side and a second PSA layer 13 on its underside, the lower second PSA layer 13 being temporarily covered by a release liner member 14. The major portion of the cover flap 20 is comprised of a flap member 15 and the minor portion is comprised of an attachment flange member 17, wherein the underside of the flap member 15 is coated with a flap release layer 16, the attachment flange member 17 being uncoated so that it permanently adheres to the PSA layer 12 to define a hinge construction. In this embodiment, the hinge-like opening of cover flap 20 is facilitated by providing underside fold line 24, which comprises a scoring or preferably an actual cut through the lowermost three layers, i.e., the second or lower PSA layer 13, the carrier member 11 and the first or upper PSA layer 12. The score or cut forming the underside fold line 24 preferably extends a short distance into the cover member 20. The flap release layer 16 extends only partially across the full width of the tape 10, such that it stops at the location of the underside fold line 24. In this manner the release layer 16 is co-extensive only with the flap member 15. An upper roll release layer 26 is disposed on the top of the cover flap 20 so that the tape 10 can be wrapped onto itself for storage purposes, the upper roll release layer 26 contacting the lower second PSA layer 13 when the tape 10 is wound for storage. The underside fold line 24 may be longitudinally coextensive with the tape 10, or the underside fold line 24 may be provided intermittently in segments. An upper side fold line 21 may also be utilized, as shown in FIG. 14, with the upper side fold line 21 disposed above the underside fold line 24. Furthermore, the cover flap 20 may be wider than the carrier member 11, and a leading edge fold line may be disposed on the undersurface of the cover flap 20.

In paper web spooling, cutting, turn-up and transfer operations, a rapidly moving paper web 50 passes over a reel drum 51 of relatively large diameter in comparison to the spools 52 upon which the paper web 50 is wound to create a paper reel 53. When a first spool 52 is fully loaded, the paper web 50 must be cut and directed onto a second, empty spool 52, which is mounted onto a primary arm 54 that positions the second spool 52 in the location now vacated by the loaded first spool 52. The cutting and transfer operation is performed by use of a transfer tape having an adhesive layer on both sides, such that the tape itself cuts the paper web 50, adheres to the newly created leading edge of the paper web 50 and secures the paper web 50 to the new spool 52. Such operations and techniques are well known in the industry.

Figure 7:
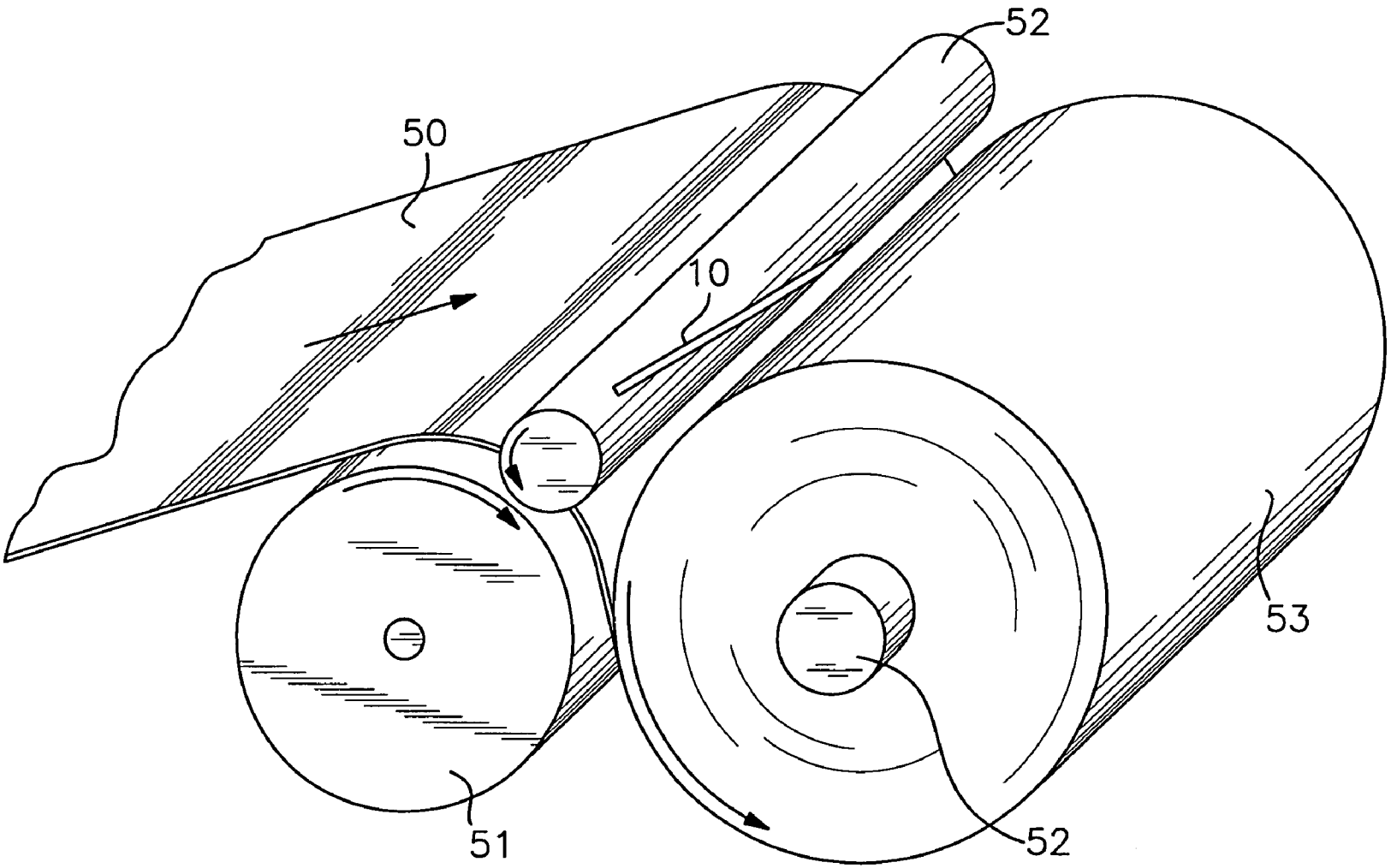
FIG. 7 is an illustration of the transfer tape in use in the web transfer operation.
Figure 8:
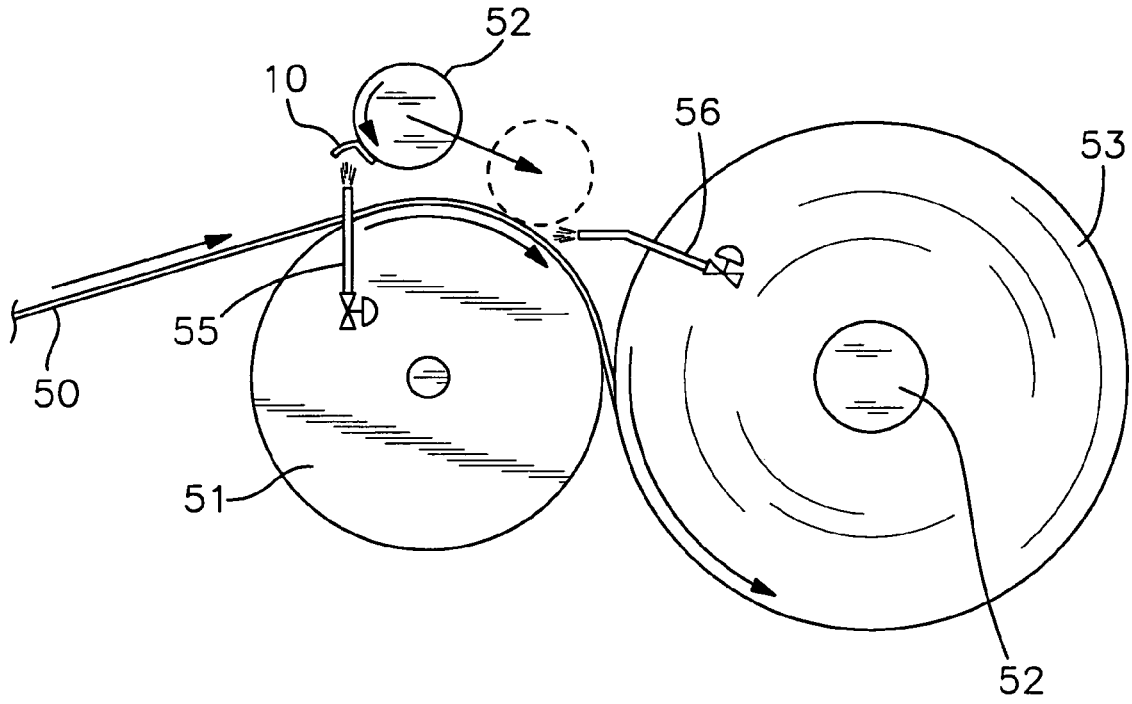
FIG. 8 is a side view of the web transfer operation, showing the addition of high pressure air jets to open the cover flap of the transfer tape and to initiate severing of the web.
Figure 9:
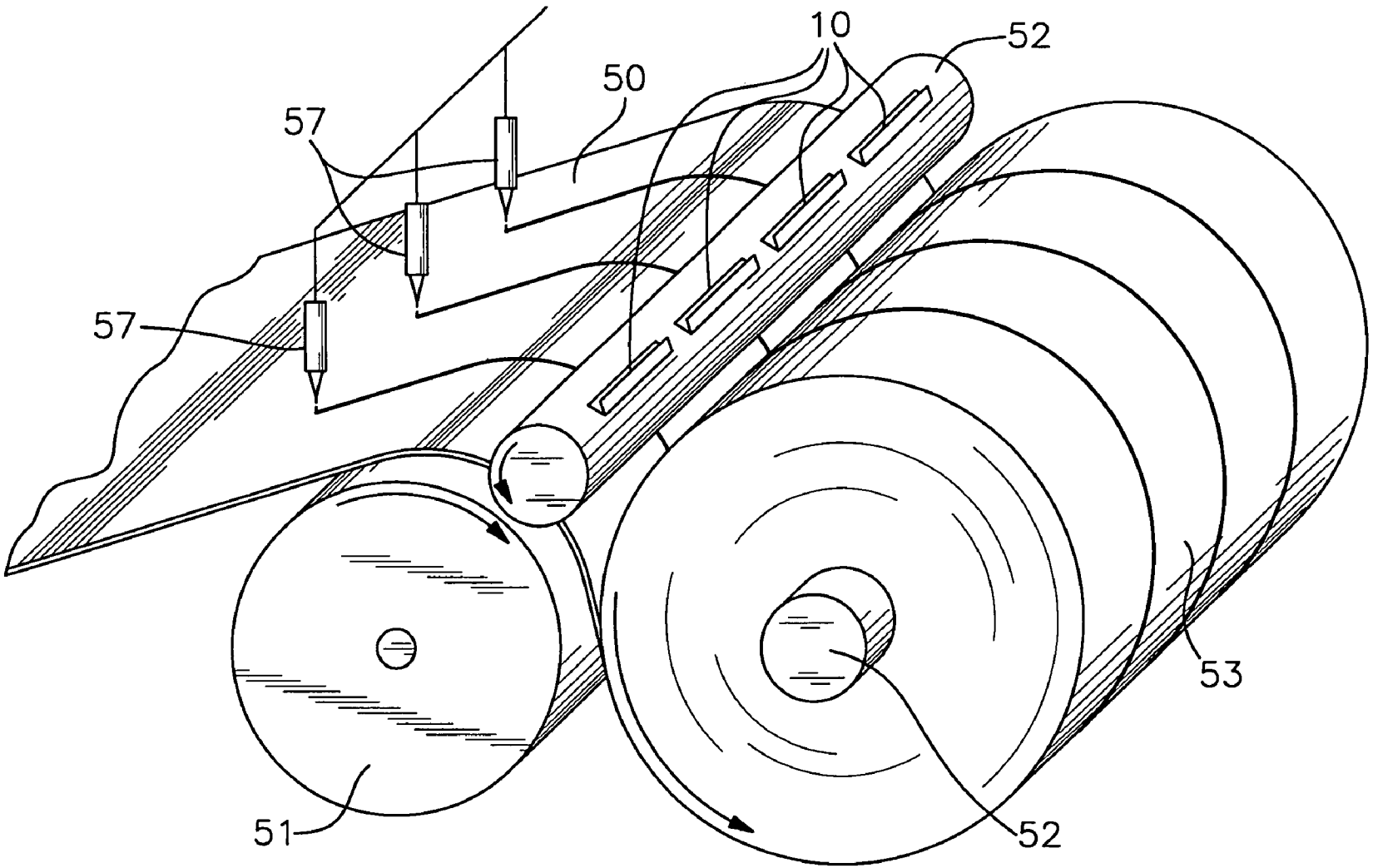
FIG. 9 is a perspective view of the web transfer operation, wherein high pressure water jets are used to cut the paper web longitudinally.

This operation is illustrated in FIGS. 7, 8 and 9. If present, the release liner member 14 is first removed to expose the second PSA adhesive layer 13 and the transfer tape 10 is applied generally longitudinally to the empty spool 52 mounted on the primary arm 54. The transfer tape 10 may be applied in a straight or helical manner to the empty spool 52. The spool 52 rotates in the direction opposite to the rotation direction of the reel drum 51, so that where the reel drum 51 is seen as rotating in a clockwise manner as shown in the drawings, the spool 52 will be rotating in a counter-clockwise manner. The transfer tape 10 is applied to the spool 52 such that the leading edge 19 of the transfer tape 10 is in the forward direction of rotation on the spool 52. Because the cover flap 20 is prevented from adhering to the first PSA layer 12, the air pressure encountered due to the rapid forward motion of the transfer tape 10 causes the cover flap 20 to open and bend backward from the first PSA layer 12, completely exposing first PSA layer 12 as the spool 52 rotates and is brought into contact with the advancing paper web 50. The now exposed first PSA layer 12 contacts and adheres to the paper web 50. This adhesion causes the paper web 50 to tear and transfer onto the spool 52, such that the paper web 50 is now being spooled onto an empty spool 52. Because the cover flap 20 has covered the first PSA layer 12 until the time of actual use, the adhesive properties of the transfer tape 10 have not been denigrated by environmental dust, floating paper fibers and other atmospheric debris.

In an alternative method, where the transfer tape 10 is constructed as shown in FIGS. 2 and 4 with an adhesive tab member 30, after applying the tape 10 to the empty spool 52 the opening of the cover flap 10 is initiated by removing the tab release liner member 34 to expose the second PSA layer 33, such that on a first revolution the tab member 30 adheres briefly to the reel drum 51, the tab member 30 being positioned on the spool 52 beyond the edge of the paper web 50. The continued rotation causes the cover flap 20 to then fully open such that the first PSA layer 12 contacts and adheres to the paper web 50, tearing it and transferring it to the spool 52. This embodiment is useful where the rotation speed of the spool 52 is not sufficient by itself to open the cover flap 20.

In a further alternative method, the opening of the cover flap 20 and tearing of the paper web 50 after the transfer tape 10 has been adhered to the paper web 50 may be assisted by providing pressurized air directed through nozzles or jets of pressurized air means 55 and 56, as shown in FIG. 8. A blast of pressurized air from pressurized air means 55 is directed against the leading edge 19 of the cover flap 20 immediately prior to the transfer tape 10 first contacting the paper web, causing the cover flap 20 to open to expose the first PSA layer 12. This application of forced air from pressurized air means 55 is useful in circumstances where the rotation speed of the spool 52 is not sufficient by itself to expose the first PSA layer 12. Furthermore, where the paper web 50 is relatively heavy, pressurized air means 56 may be disposed on the edge of the paper web 50 at the location where the transfer tape 10 adheres to the spool 52 and the paper web 50 begins to rotate away from the reel drum 51, such that a pressurized air blast from pressurized air means 56 initiates the tear in the paper web 50, such that the adhesion to the transfer tape 10 propagates the tear across the full width of the paper web 50.

In still another alternative methodology, as shown in FIG. 9, the transfer tape 10 is applied to the spool 52 in segments rather than in a continuous length, where the discontinuities of the adjacent tape segments correspond to longitudinal cuts made in the paper web 50 by high pressure water jets 57 or the like prior to reaching the reel drum 51. In this manner, each of the longitudinal segments of the paper 50 can now be simultaneously transferred to the spool 52 as previously discussed.

Figure 18:
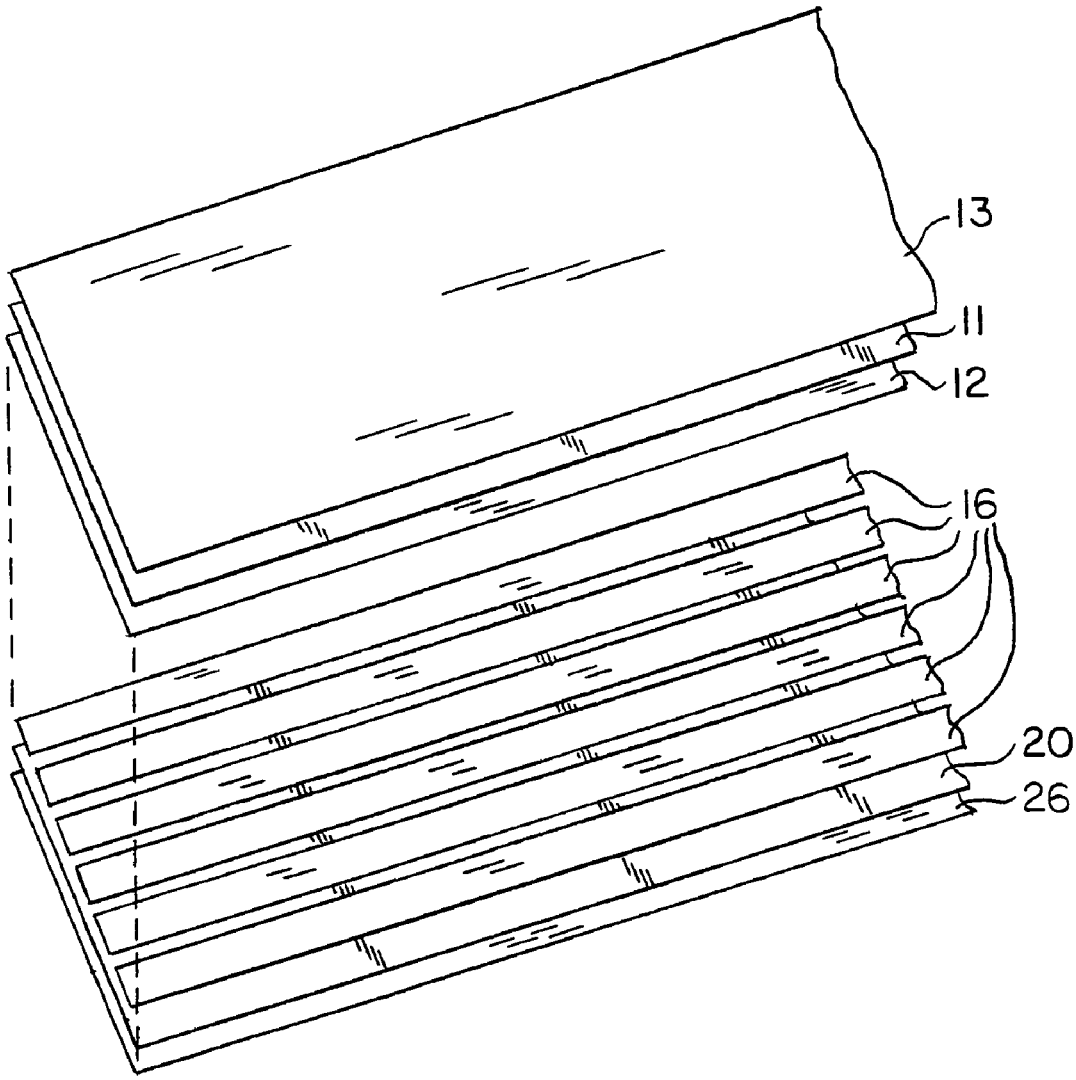
FIG. 18 shows in an exploded view an embodiment for producing a plurality of individual transfer tapes utilizing wide layer members to which the coating layers are applied, the multi-layer product then being cut longitudinally to produce the individual transfer tapes.

The transfer tape 10 may be manufactured in multi-layer sheet form, with the final multi-layer sheet cut into longitudinal strips to produce individual transfer tapes 10. An embodiment for one such method suitable for creating transfer tapes 10 for the embodiments shown in FIGS. 13 through 17 is illustrated in FIG. 18, with the tape 10 shown in an inverted view in comparison to the those figures. As shown, flap release layer 16 is applied as a coating to cover flap 20 in spaced longitudinal zones or strips. In this manner, thin longitudinal strips of cover flap 20 will directly contact the first PSA layer 12 and adhere thereto to create attachment flange members 17. The areas of cover flap 20 residing adjacent the flap release layers 16 will become flap members 15. When the multi-layer sheet is cut longitudinally between the release layer 16 strips to divide the individual transfer tapes 10, each tape 10 will comprise an attachment flange member 17 and a flap member 15.

It is contemplated that equivalents and substitutions to certain elements and features set forth above may be obvious to those skilled in the art, and thus the true scope and definition of the invention is to be as set forth in the following claims.

I claim:

1. A paper web transfer tape comprising:

an elongated carrier member having a first side, a second side, a longitudinal leading edge and a longitudinal trailing edge, a first adhesive layer disposed on said first side of said carrier member, and a second adhesive layer disposed on said second side of said carrier member;

a cover flap permanently attached to said carrier member adjacent said longitudinal trailing edge of said carrier member and disposed adjacent said first adhesive layer, said cover flap having an upper side and an underside, wherein said cover flap opens in a hinged manner to expose said first adhesive layer and wherein said cover flap remains attached to said carrier member when fully opened; and an underside fold line disposed on said cover flap.

2. The tape of claim 1, wherein said cover flap comprises an attachment flange member; a flap member and a flap release layer present on the underside of said cover flap adjacent said flap member such that said flap member does not adhere to said first adhesive layer, whereby said attachment flange member does adhere to said first adhesive layer.

3. The tape of claim 1, wherein said cover flap is not attached to said carrier member at said leading edge and extends beyond said leading edge.

4. The tape of claim 1, said cover flap further comprising an upper side longitudinal fold line near said longitudinal trailing edge and positioned between said attachment flange member and said flap member.

5. The tape of claim 1, wherein said underside fold line is near said longitudinal leading edge, said underside fold line defining an initiator flap member that opens prior to said cover flap.

6. The tape of claim 1, further comprising a removable liner member joined to said second adhesive layer.

7. The tape of claim 1, further comprising an upper roll release layer present on the upper side of said cover flap.

8. The tape of claim 1, wherein said cover flap is wider than said carrier member.

9. A paper web transfer tape comprising:

an elongated carrier member having a first side, a second side, a longitudinal leading edge and a longitudinal trailing edge, a first adhesive layer disposed on said first side of said carrier member, and a second adhesive layer disposed on said second side of said carrier member;

a cover flap permanently attached to said first adhesive layer of said carrier member adjacent said longitudinal trailing edge of said carrier member, said cover flap having an upper side and an underside, said cover flap comprising an attachment flange member and a flap member;

a flap release layer disposed on the underside of said cover flap that is not coextensive, said flap release layer being disposed on said flap member and not disposed on said attachment flange member, such that said attachment flange member adheres to said first adhesive layer and such that said flap member does not adhere to said first adhesive layer;

wherein said flap member of said cover flap opens in a hinged manner to expose said first adhesive layer and wherein said attachment flange member of said cover flap remains attached to said carrier member when fully opened; and an underside fold line longitudinally disposed on said cover flap.

10. The tape of claim 9, wherein said underside fold line is a longitudinal cut extending through said second adhesive layer, said carrier member and said first adhesive layer, and wherein said longitudinal cut extends partially into said cover flap.

11. The transfer tape of claim 10, wherein said flap release layer extends to said underside fold line.

12. The tape of claim 9, wherein said underside fold line is intermittent in the longitudinal direction.

13. The tape of claim 9, further comprising an upper side fold line disposed on said cover flap above said underside fold line.

14. The transfer tape of claim 9, wherein said cover flap is wider than said carrier member.

15. The transfer tape of claim 9, further comprising a coextensive upper roll release layer disposed on the upper side of said cover flap.

16. The transfer tape of claim 9, further comprising a removable liner member joined to said second adhesive layer.

* * * * *